US006651780B1

(12) United States Patent
Hakala et al.

(10) Patent No.: US 6,651,780 B1
(45) **Date of Patent: *Nov. 25, 2003**

(54) TRACTION SHEAVE ELEVATOR, HOISTING UNIT AND MACHINE SPACE

(75) Inventors: Harri Hakala, Hyvinkää (FI); Jorma Mustalahti, Hyvinkää (FI); Esko Aulanko, Kerava (FI)

(73) Assignee: Kone Oy, Helsinki (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/333,678

(22) Filed: Jun. 16, 1999

Related U.S. Application Data

(63) Continuation of application No. 08/896,531, filed on Jul. 18, 1997, now Pat. No. 6,148,962, which is a continuation of application No. 08/433,077, filed on May 3, 1995, now abandoned, which is a continuation-in-part of application No. 08/264,343, filed on Jun. 23, 1994, now Pat. No. 5,429,211.

(30) Foreign Application Priority Data

| | | |
|---|---|---|
| Jun. 28, 1993 | (FI) | 932977 |
| Apr. 14, 1994 | (FI) | 941719 |
| May 4, 1994 | (FI) | 942062 |

(51) Int. Cl.[7] ..... B66B 11/08
(52) U.S. Cl. ..... 187/254
(58) Field of Search ..... 187/254, 266, 187/333, 325, 406

(56) References Cited

U.S. PATENT DOCUMENTS 12,640 A 4/1855 Murtaugh (List continued on next page.)

FOREIGN PATENT DOCUMENTS

| | | |
|---|---|---|
| CA | A12127873 | 7/1993 |
| CH | 436629 | 11/1967 |

(List continued on next page.)

OTHER PUBLICATIONS

Title—Elevator Machinery; inventors: Ing. Fuller and Ing. Knorzer dated Sep. 16, 1954, 15 pages.

"PC Brushless Motor and Control Circuit" Table of Contents and pp. 42, 43 and 204; Nov. 01, 1994.

*Primary Examiner*—Khoi H. Tran
(74) *Attorney, Agent, or Firm*—Birch, Stewart, Kolasch & Birch, LLP

(57) ABSTRACT

Traction sheave elevator consisting of an elevator car moving along elevator guide rails, a counterweight moving along counterweight guide rails, a set of hoisting ropes (3) on which the elevator car and counterweight are suspended, and a drive machine unit (6) driving a traction sheave (7) acting on the hoisting ropes (3) and placed in the elevator shaft. The drive machine unit (6) is of a flat construction. A wall of the elevator shaft is provided with a machine space with its open side facing towards the shaft, the essential parts of the drive machine unit (6) being placed in the space. The hoisting unit (9) of the traction sheave elevator consists of a substantially discoidal drive machine unit (6) and an instrument panel (8) mounted on the frame (20) of the hoisting unit.

118 Claims, 3 Drawing Sheets

U.S. PATENT DOCUMENTS

| | | | | |
|---|---|---|---|---|
| 568,567 | A | 9/1896 | Herdman | |
| 789,765 | A | 5/1905 | Smith | |
| 799,337 | A | 9/1905 | De Buren | |
| 1,126,260 | A | 1/1915 | Neenan | |
| 1,566,385 | A | 12/1925 | Dunn | |
| 3,101,130 | A | 8/1963 | Bianca | |
| 4,085,823 | A | 4/1978 | Caputo et al. | |
| 4,739,969 | A | 4/1988 | Eckersley et al. | |
| H702 | H | 11/1989 | Shively et al. | |
| 4,960,186 | A | 10/1990 | Honda | |
| 4,977,980 | A | 12/1990 | Hifumi | |
| 5,018,603 | A | 5/1991 | Ito | |
| 5,036,954 | A | 8/1991 | Haahtikivi et al. | |
| 5,140,212 | A | 8/1992 | Iwasaki et al. | |
| 5,144,183 | A | 9/1992 | Farrenkopf | |
| 5,152,369 | A | 10/1992 | Nakaoka | |
| 5,299,662 | A | 4/1994 | Reddy et al. | |
| 5,589,722 | A | 12/1996 | Sakaguchi et al. | |
| 6,148,962 | A | * 11/2000 | Hakala et al. | 187/254 |

FOREIGN PATENT DOCUMENTS

| | | |
|---|---|---|
| DE | U 7395 | 9/1954 |
| DE | 1033383 | 7/1958 |
| DE | 3802386 A1 | 8/1988 |
| DE | 3922798 C1 | 9/1990 |
| EP | 415218 | 3/1991 |
| EP | 0631967 | 1/1995 |
| GB | 2201657 | 9/1988 |
| GB | 2201657 | 9/1998 |
| JP | 51-20351 | 2/1976 |
| JP | 51-139044 | 12/1976 |
| JP | 52-32870 | 3/1977 |
| JP | 55-7149 | 1/1980 |
| JP | 58184480 | 10/1983 |
| JP | 59-40276 | 3/1984 |
| JP | 61-150982 | 7/1986 |
| JP | 62-230587 | 10/1987 |
| JP | 63-56170 | 3/1988 |
| JP | 4-50297 | 8/1988 |
| JP | 64-211180 | 1/1989 |
| JP | 1-187187 | 7/1989 |
| JP | 1-267286 | 10/1989 |
| JP | 1-30467 | 12/1989 |
| JP | 2-62394 | 3/1990 |
| JP | 2-225280 | 9/1990 |
| JP | 3-124688 | 5/1991 |
| JP | 4-50297 | 2/1992 |
| JP | 5-78066 | 3/1993 |
| JP | 7-137962 | 5/1995 |
| JP | 7-144857 | 6/1995 |
| NL | 154553 | 12/1902 |
| WO | WO93/14551 | 7/1993 |
| WO | WO 9528028 | 10/1995 |

* cited by examiner

TRACTION SHEAVE ELEVATOR, HOISTING UNIT AND MACHINE SPACE

This application is a s continuation of application Ser. No. 08/896,531, filed on Jul. 18, 1997, now U.S. Pat. No. 6,148,962, which is a continuation of 08/433,077, filed May 3, 1995, now abandoned; which is a continuation-in-part of 08/264,343, filed Jun. 23, 1994, now U.S. Pat. No. 5,429, 211; the entire contents of all of which are hereby incorporated by reference.

The present invention relates to a traction sheave elevator a hoisting unit and a machine space as described hereinbelow.

BACKGROUND OF THE INVENTION

One of the objectives in elevator development has been to achieve an efficient and economic space utilization. In conventional traction sheave driven elevators, the elevator machine room or other space for the drive machinery takes up a considerable part of the building space required for the elevator. The problem is not only the volume of the space required by the elevator, but also its placement in the building. There are various solutions for the placement of the machine room, but they generally involve significant restrictions as to the design of the building at least with regard to space utilization or appearance. For example, in the case of a so-called side-drive elevator with machine room below, a machine room or space is required below or beside the shaft, generally on the bottommost floor of the elevator system. Being a special space, the machine room generally increases the building costs.

SUMMARY OF THE INVENTION

To meet the need to achieve at an economic cost a reliable elevator allowing efficient space utilization and in which, irrespective of the hoisting height, the building space required for the elevator is substantially limited to the space needed by the elevator car and counterweight on their paths, including the safety distances, and the space needed to provide a passage for the hoisting ropes, and in which the problems or drawbacks described above can be avoided, a new type of traction sheave elevator is proposed as an invention. The traction sheave elevator of the invention is characterized by an elevator car moving along elevator guide rails, a counterweight moving along counterweight guide rails, a set of hoisting ropes on which the elevator car and counterweight are suspended in the elevator shaft, and a drive machine unit driving a traction sheave placed in the elevator shaft and acting on the hoisting ropes, the drive machine unit being flat in the direction of the drive shaft of the traction sheave, and a wall of the elevator shaft containing a machine space in which the essential parts of the drive machine unit are placed. The hoisting unit of the invention is characterized by the hoisting unit comprising a discoidal drive machine unit and an instrument panel attached to a frame of the hoisting unit. The machine space of the invention is characterized by the machine space being delimited in the thicknesswise direction of a wall by the plane of the wall surface facing towards an elevator shaft and the plane of the wall surface facing towards from the elevator shaft. Other embodiments of the invention are characterized by the features presented in the other claims.

Various advantages can be achieved by applying the invention, including the following:

The traction sheave elevator of the invention allows an obvious space saving to be achieved in the building because no separate machine room is required.

The elevator is cheap to install as the elevator machinery can be assembled and tested beforehand in factory.

Applying the invention to practice requires no major changes in the design or manufacture of the elevator.

The machinery and the instrument panel are within easy reach, so the manner of accessing the machinery for maintenance or in an emergency does not essentially differ from conventional elevators.

BRIEF DESCRIPTION OF THE DRAWINGS

In the following, the invention is described in detail by the aid of one of its embodiments by referring to the attached drawings, in which.

DETAILED DESCRIPTION OF THE INVENTION

Figure 1:
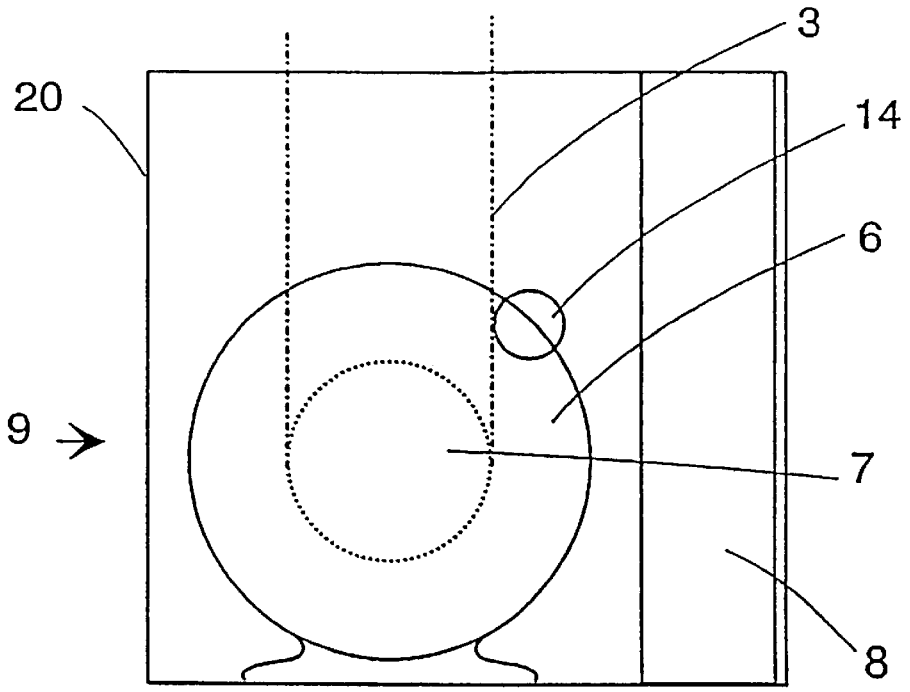
FIG. 1 presents a diagrammatic view of a hoisting unit employed in the invention.

FIG. 1 presents a hoisting unit 9 for a traction sheave elevator as provided by the invention. The unit in this figure is the hoisting unit of a traction sheave elevator with machinery below, in which the hoisting ropes 3 go upwards from the traction sheave 7 of the hoisting machinery 6. In the case of an elevator with machinery above, the ropes would go downwards. The hoisting machinery 6 is fixed to the support 20 of the hoisting unit, which 20 is preferably of a frame-like design. Mounted on the frame 20 is also an instrument panel 8, which contains the elevator control equipment and the equipment needed for the control of and supply of power to the electromotor comprised in the hoisting machinery 6. The hoisting machinery 6 is of a discoidal shape and, in relation to its diameter, relatively flat in the direction of the traction sheave shaft. The traction sheave 7 protrudes from the discoidal hoisting machinery 6 into the shaft space. Placed on the circumference of the hoisting machinery 6 is a brake 14. An elevator machinery usable as a hoisting machinery 6 is described e.g. in Finnish patent application 941599. Such a machinery does not require a large machine space, so it can easily be placed in an opening in the wall or in a recess made in the wall on the side facing towards the shaft. A preferable thickness of the hoisting unit 9 is about or somewhat over ten centimeters. The traction sheave 7 is not included in this thickness. A 10 cm thick hoisting unit 9 can readily be accommodated in an ordinary elevator shaft wall because a typical wall thickness is at least about 15 cm, both in the case of a cast concrete wall and a brick wall.

Figure 2:
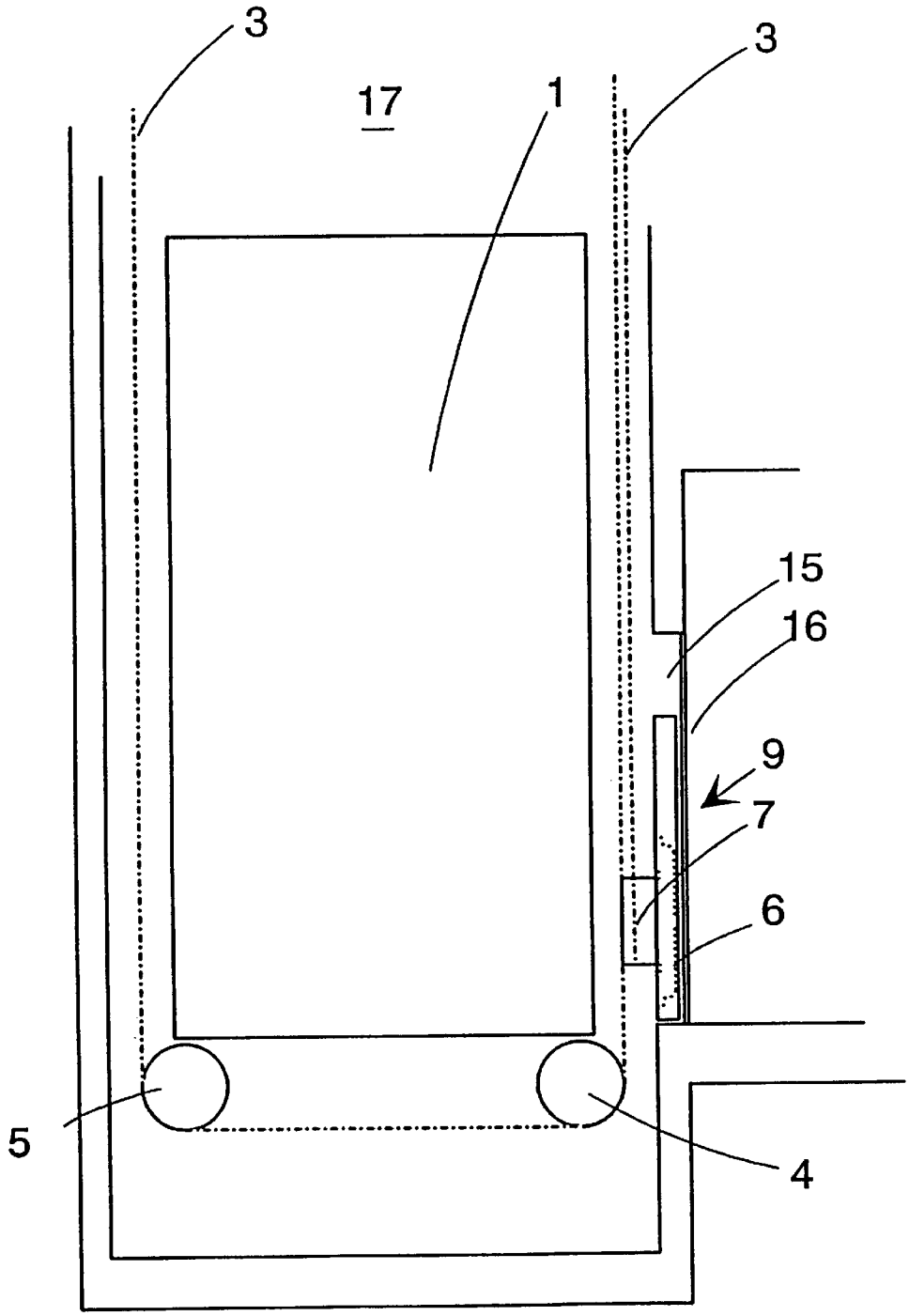
FIG. 2 presents an elevator with machinery below in which the invention is applied.

FIG. 2 presents an elevator with machinery below in which the invention is applied, the hoisting unit 9 being placed beside the shaft in its lower part. The main parts of the elevator machinery 6 are mounted in a space limited in its maximum by the thickness of the wall of the elevator shaft 17, in an opening 15 in the wall which is open towards the shaft space and closed with a door 16 from the outside to prevent illicit access to the machinery or entry into the shaft through the opening 15. On the shaft side, the opening may be provided with a safety net or glass or the like to make sure that one cannot e.g. stretch a hand into the shaft space past the equipment in the opening. In general, it is not sensible to close the machine space 15 completely from the shaft side because, regarding ventilation of the machine space 15, an advantageous solution is one in which the machine space is ventilated through the shaft. In some cases, however, closing the machine space on the shaft side may be necessary e.g. to stop the propagation of noise. In such cases the machine space 15 is closed on the shaft side except for the inlets required for power transmission to the traction sheave 7 and other purposes. In any case, the machine space 15 has a depth not exceeding the thickness of the wall of the elevator shaft 17. From the hoisting machinery 6 comprised in the hoisting unit, the traction sheave 7 moving the hoisting ropes 3 (depicted in broken lines) protrudes into the shaft 17. The figure shows the portion of the hoisting ropes passing below the car 1 over diverting pulleys 4,5 and the portion coming down from the upper part of the shaft 17 to the traction sheave.

Figure 3:
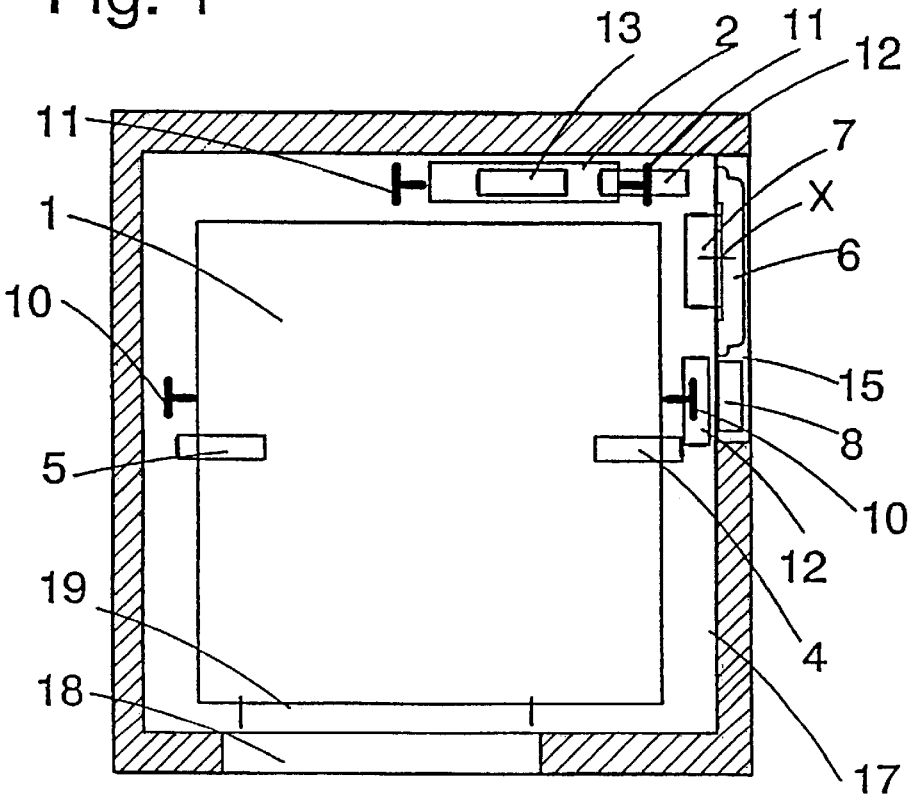
FIG. 3 presents the layout of the main components of an elevator applying the invention, projected on the cross-section of the elevator shaft.

FIG. 3 presents the layout of the main components of an elevator with machinery below, projected on the cross-section of the elevator shaft 17. The elevator car 1 moves along elevator guide rails 10 and the counterweight 2 along counterweight guide rails 11. The hoisting machinery 6 and the instrument panel 8 are placed in an opening in the wall of the elevator shaft 17. The traction sheave 7 protrudes from the hoisting machinery 6 and also from the opening 15 into the shaft 17. The axis of rotation for shaft 17 is indicated as X. Diverting pulleys 12 placed in the top part of the shaft guide the passage of the hoisting ropes. One of the diverting pulleys 12 guides the hoisting ropes from the traction sheave 7 to the diverting pulley 13 on which the counterweight 2 is suspended and from which the hoisting ropes go further to a fixed rope anchorage at the top of the shaft. Another diverting pulley 12 guides the hoisting ropes from the traction sheave 7 to the diverting pulleys 4 and 5 attached to the car 1, by means of which the elevator car 1 is suspended on the hoisting ropes and from which the ropes go further to a fixed rope anchorage at the top of the shaft. In the figure, the hoisting ropes are represented by their cross-sections on the traction sheave and diverting pulleys, but otherwise the ropes are not shown. At each landing, the wall of the elevator shaft 17 is provided with a door opening 18 for the landing door. The elevator car 1 is provided with a corresponding door opening 19. If the elevator car is provided with a door, its door opening 19 is closed by the car door.

Figure 4:
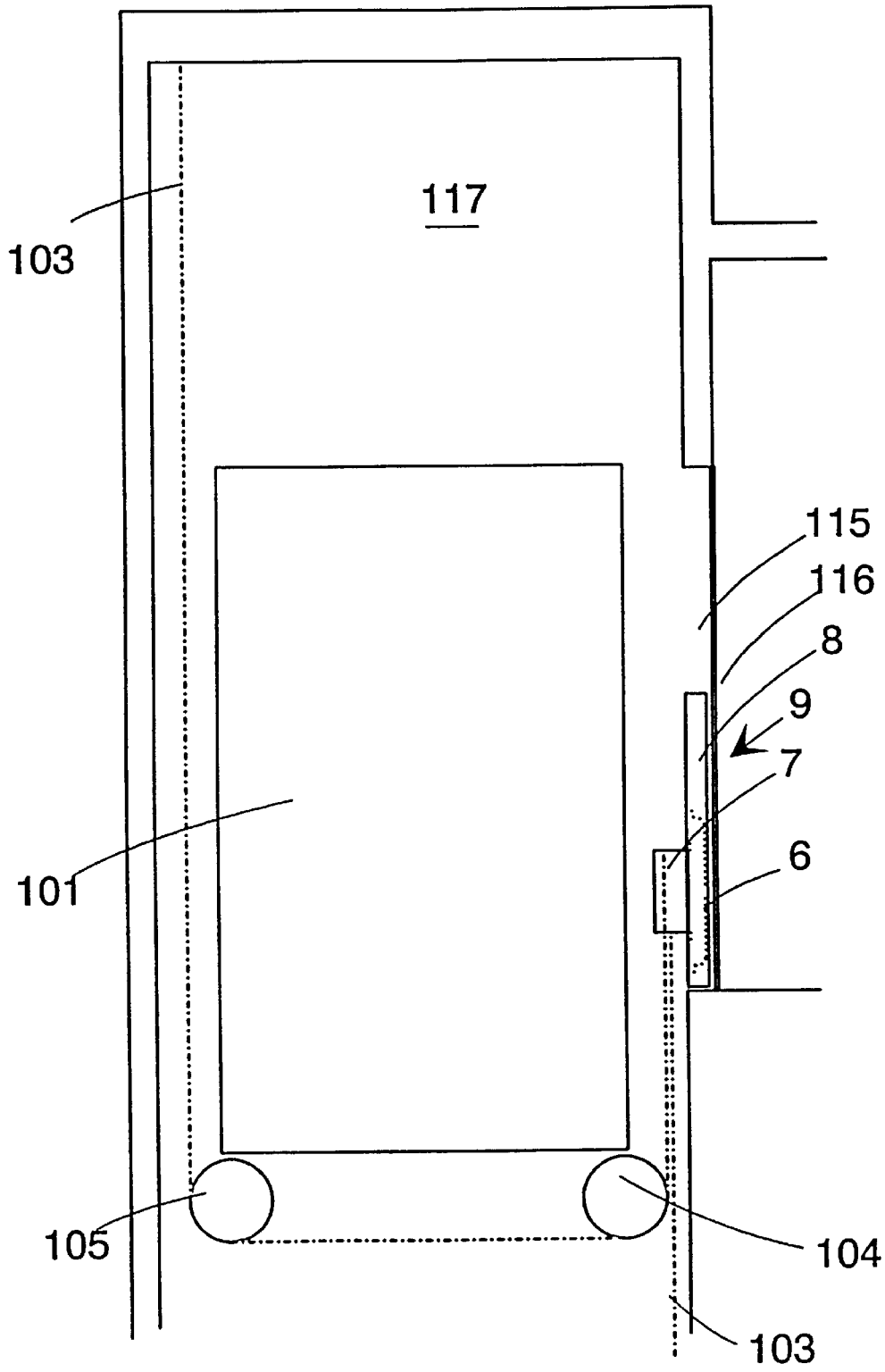
FIG. 4 presents an elevator with machinery above, implemented according to the invention.

FIG. 4 presents a diagram representing an elevator with machinery above, implemented according to the invention. The hoisting unit 9 is placed beside the elevator shaft 117 in its upper part. The elevator machinery 6 is mounted in an opening 115 in the wall of the elevator shaft 117. The opening is open towards the shaft and closed with a door 116 from the outside of the shaft. From the hoisting machinery 6 comprised in the hoisting unit, the traction sheave 7 moving the hoisting ropes 103 (depicted in broken lines) protrudes into the shaft 117. The figure shows the portion of the hoisting ropes passing below the car 101 over diverting pulleys 104,105 and the portion going from the traction sheave towards the counterweight.

It is obvious to a person skilled in the art that different embodiments of the invention are not restricted to the examples described above, but that they may instead. be varied within the scope of the claims presented below. For instance, the lay-out of the car and. counterweight in the shaft is not a decisive question. It is also obvious to the skilled person that the drive shaft of the traction sheave can be provided with a support on the side facing the shaft as well, e.g. by using a support beam attached to the frame of the hoisting machinery. The skilled person also knows that the traction sheave comprised in an elevator machinery is frequently not a fixed part of the machinery but a component which need not be mounted on its drive shaft until during installation of the elevator.

What is claimed is:

1. A traction sheave elevator system comprising:

an elevator shaft structure having at least one wall;

a plurality of guide rails;

an elevator car movable along the plurality of elevator guide rails;

a counterweight movable along a plurality of counterweight guide rails;

a set of hoisting ropes on which the elevator car and counterweight are suspended in the elevator shaft structure;

a motor having an axis of rotation oriented in the elevator shaft; and a traction sheave driven by the motor on the axis of rotation;

the motor being flat in the direction of the drive shaft, the elevator shaft including at least one shaft wall adjacent the elevator car;

the at least one shaft wall contains a machine space being defined in the shaft wall, the motor being mounted and contained within the machine space such that the motor does not extend beyond an outer surface of the at least one shaft wall.

2. The system as defined in claim 1, wherein the machine space is open at one side towards an interior of the elevator shaft structure and has a door at the opposite side.

3. The system as defined in claim 1 or 2, wherein the motor is a discoidal motor and the system further comprises an instrument, said instrument panel containing equipment required for the control of and supply of power to the elevator car.

4. The system as defined in claim 3, wherein the machine space for the motor is disposed in a lower part of the at least one shaft wall.

5. The system as defined in claim 3, wherein the machine space for the motor is disposed in an upper part of the at least one shaft wall.

6. The system as defined in claim 3, wherein the machine space is provided with an access restricting element.

7. A hoisting unit for a traction sheave elevator and an elevator shaft having shaft walls, the hoisting unit being mountable in the elevator shaft, the hoisting unit comprising a main portion including:

a frame, a discoidal drive machine unit attached to the frame, and an instrument panel attached to the frame of the hoisting unit, said frame being positioned in an opening or recess of the elevator shaft wall.

8. The hoisting unit as defined in claim 7, wherein, in one direction, the main portion has a thickness not exceeding that of the wall, the wall being formed from a conventional cast concrete or brick.

9. A machine space in a wall defining an elevator shaft structure for a traction sheave elevator, the wall having a pair of opposed surfaces, wherein the machine space is a hole extending between the pair of opposed surfaces and is delimited in the thicknesswise direction of the wall by the plane of each of the pair of opposed surfaces, at least a portion of a drive machine unit for an elevator being positionable in the machine space, the drive machine unit including a discoidal motor and a traction sheave with a majority of the discoidal motor being positionable within the machine space.

10. The system as defined in claim 7, wherein the shaft wall having the opening or recess has opposed surfaces with the opening or recess being contained between the opposed surfaces.

11. The system as defined in claim 10, wherein a majority of the frame is contained within the opening, in the shaft wall.

12. The system as defined in claim 10, wherein substantially all of the frame is contained within, the opening in the shaft wall.

13. The system as defined in claim 10, wherein the frame is entirely contained within the opening in the shaft wall.

14. The system as defined in claim 9, wherein the machine space contains hoisting equipment including the drive machine unit with discoidal motor which only extends from the space through one of the planes of the pair of opposed surfaces of the wall to the traction sheave.

15. The system as defined in claim 9, wherein the machine space is closed on one side thereof which side is coincident with one of the planes of the pair of opposed surfaces of the wall.

16. The system as defined in claim 9, wherein the machine space is completely closed on one side thereof which side is coincident with one of the planes of the pair of opposed surfaces of the wall.

17. A traction sheave drive assembly for an elevator car which minimizes the space occupied thereby in an elevator shaft, said elevator shaft including at least one substantially vertical wall defining a space between it and an adjacent elevator car, said drive assembly being mounted in said shaft and comprising:

a discoidal electric motor having a stator, a rotor, and an axis of rotation oriented in at least an extension of said space in said elevator shaft such that an extension of said axis will intersect the vertical wall; and a traction sheave driven by said motor on said axis of rotation.

18. The invention of claim 17, wherein said drive assembly is so dimensioned as to present said traction sheave in said shaft in an extension of the space defined between said vertical wall and said elevator car adjacent to said wall.

19. The invention of claim 17, wherein said drive assembly is so dimensioned as to present said traction sheave in said shaft in an extension of the space defined between said vertical wall and said elevator car adjacent to said wall;

said shaft wall has a finite thickness;

said discoidal electric motor has a thickness along its axis of rotation no greater than said finite thickness; and said discoidal electric motor is mounted within said shaft wall.

20. The invention of claim 19, wherein said discoidal electric motor is completely contained within said shaft wall.

21. The invention of claim 17, wherein said drive assembly is mounted entirely within said extension of said space.

22. A traction sheave drive assembly for an elevator car which minimizes the space occupied thereby in an elevator shaft, said drive assembly being mounted in said shaft and comprising:

a discoidal electric motor having a stator, a rotor, and an axis of rotation;

a traction sheave driven by said motor on said axis of rotation;

said elevator shaft including a shaft wall adjacent said elevator car;

said shaft wall having a finite thickness;

said discoidal motor being mounted and contained within the thickness of said shaft wall; and said traction sheave being presented for rotation in said shaft.

23. The invention of claim 22, wherein said discoidal electric motor is completely contained within said shaft wall.

24. A traction sheave drive assembly for an elevator car which minimizes the space occupied thereby in an elevator shaft, said drive assembly being mounted in said shaft and comprising:

a discoidal motor having an axis of rotation oriented in said elevator shaft such that said axis will intersect an adjacent elevator car; and a traction sheave driven by said motor on said axis of rotation;

said elevator shaft being a vertical shaft with a vertically extending boundary, the elevator shaft including a shaft wall adjacent said elevator car;

said shaft wall having a finite thickness and being adjacent the vertically extending boundary of the shaft; and said discoidal motor being mounted and contained within the vertically extending boundary of the shaft.

25. The invention of claim 24, wherein said discoidal motor is mounted and contained within the thickness of said shaft wall.

26. The invention of claim 25, wherein said discoidal electric motor is completely contained within said shaft wall.

27. A traction sheave drive assembly for an elevator car which minimizes the space occupied thereby in an elevator shaft, said elevator shaft including at least one substantially vertical wall defining a space between it and an adjacent elevator car, said drive assembly being mounted in said shaft and comprising:

a discoidal electric motor having a stator, a rotor, and an axis of rotation oriented in at least an extension of said space in said elevator shaft such that an extension of said axis will intersect the plane of said vertical wall; and a traction sheave driven by said motor on said axis of rotation;

said traction sheave drive assembly further comprising:

a counterweight being mounted in said shaft in a space defined between and edge of said shaft and said elevator car; and a traction rope interconnected between said counterweight, said traction sheave and said elevator car.

28. The invention of claim 27, wherein said traction sheave has a diameter less than the diameter of at least one of said stator and said rotor of said discoidal motor.

29. The invention of claim 27, wherein said drive assembly is so dimensioned as to present said traction sheave in said shaft in an extension of the space defined between said shaft wall and said elevator car adjacent to said wall.

30. The invention of claim 27, wherein said drive assembly is so dimensioned as to present said traction sheave in said shaft in an extension of the space defined between said shaft wall and said elevator car adjacent to said wall;

said shaft wall has a finite thickness;

said discoidal electric motor has a thickness along its axis of rotation no greater than said finite thickness; and said discoidal electric motor is mounted within said shaft wall.

31. The invention of claim 30, wherein said discoidal electric motor is substantially completely contained within said shaft wall.

32. The invention of claim 27 or 28, wherein said drive assembly is mounted entirely within said extension of said space.

33. A traction sheave drive assembly for an elevator car which minimizes the space occupied thereby in an elevator shaft, said drive assembly being mounted in said shaft and comprising:

a discoidal electric motor having a stator, a rotor, and an axis of rotation;

a traction sheave driven by said motor on said axis of rotation;

said elevator shaft including a shaft wall adjacent said elevator car;

said shaft wall having a finite thickness;

said discoidal motor being mounted and contained within the thickness of said shaft wall; and said traction sheave being presented for rotation in said shaft;

said traction sheave drive assembly further comprising:

a counterweight for and being mounted in said shaft in a space defined between an edge of said shaft and said elevator car; and a traction rope interconnected between said counterweight, said traction sheave and said elevator car.

34. The invention of claim 33, wherein said discoidal electric motor is completely contained within said shaft wall.

35. A traction sheave drive assembly for an elevator car which minimizes the space occupied thereby in an elevator shaft, said drive assembly being mounted in said shaft and comprising:

a discoidal electric motor having a stator, a rotor, and an axis of rotation oriented in said elevator shaft such that an extension of said axis will intersect an adjacent elevator car;

a traction sheave driven by said motor on said axis of rotation, said elevator shaft including a shaft wall adjacent said elevator car;

said shaft wall having a finite thickness;

said discoidal motor being mounted and contained within said shaft;

said traction sheave drive assembly further comprising:

a counterweight for and being mounted in said shaft in a space defined between and edge of said shaft and said elevator car; and a traction rope interconnected between said counterweight, said traction sheave and said elevator car.

36. The invention of claim 35, wherein said discoidal motor is mounted and contained within the thickness of said shaft wall.

37. The invention of claim 36, wherein said discoidal electric motor is completely contained within said shaft wall.

38. A traction sheave drive assembly for an elevator car which minimizes the space occupied thereby in an elevator shaft, said elevator shaft including at least one substantially vertical wall defining a space between it and an adjacent elevator car, said drive assembly being mounted in said shaft and comprising:

a discoidal electric motor having a stator, a rotor, and an axis of rotation oriented in at least an extension of said space in said elevator shaft such that an extension of said axis will intersect the plane of said vertical wall; and a traction sheave driven by said motor on said axis of rotation;

said traction sheave drive assembly further comprising:

a counterweight for and being mounted in said shaft in a space defined between an edge of said shaft and said elevator car; and a traction rope interconnected between said counterweight, said traction sheave and said elevator car;

said elevator car including rope engaging support structures beneath same;

said traction rope passing beneath said elevator car in engagement with said support structures and having a distal end, remote from said counterweight, attached to a fixed support structure in said shaft.

39. The invention of claim 38, wherein said elevator car is substantially rectangular in cross-section; and said traction rope passes diagonally beneath said elevator car.

40. The invention of claim 38, wherein said drive assembly is so dimensioned relative to said elevator and said shaft as to present said traction sheave in said shaft in an extension of the space defined between said shaft wall and said elevator car adjacent to said wall.

41. The invention of claim 40, wherein said elevator car and said shaft are substantially rectangular in cross-section.

42. The invention of claim 38, wherein said drive assembly is so dimensioned as to present said traction sheave in said shaft in an extension of the space defined between said shaft wall and said elevator car adjacent to said wall;

said shaft wall has a finite thickness;

said discoidal electric motor has a thickness along its axis of rotation no greater than said finite thickness; and said discoidal electric motor is mounted within said shaft wall.

43. The invention of claim 42, wherein said elevator car and said shaft are substantially rectangular in cross-section.

44. The invention of claim 42, wherein said discoidal electric motor is completely contained within said shaft wall.

45. The invention of claim 44, wherein said elevator car and said shaft are substantially rectangular in cross-section.

46. The invention of claim 45, wherein said drive assembly is mounted entirely within said extension of said space.

47. The invention of claim 46, wherein said elevator car and said shaft are substantially rectangular in cross-section.

48. A traction sheave drive assembly for an elevator car which minimizes the space occupied thereby in an elevator shaft, said drive assembly being mounted in said shaft and comprising:

a discoidal electric motor having a stator, a rotor, and an axis of rotation;

a traction sheave driven by said motor on said axis of rotation;

said elevator shaft including a shaft wall adjacent said elevator car;

said shaft wall having a finite thickness;

said discoidal motor being mounted and contained within the thickness of said shaft wall;

said traction sheave drive assembly further comprising:

a counterweight for and being mounted in said shaft in a space defined between an edge of said shaft and said elevator car; and a traction rope interconnected between said counterweight, said traction sheave and said elevator car;

said elevator car including rope engaging support structures beneath same;

said traction rope passing beneath said elevator car in engagement with said support structures and having a distal end, remote from said counterweight, attached to a fixed support structure in said shaft.

49. The invention of claim 48, wherein said elevator car and said shaft are substantially rectangular in cross-section.

50. The invention of claim 48, wherein said discoidal electric motor is completely contained within said shaft wall.

51. The invention of claim 50, wherein said elevator car and said shaft are substantially rectangular in cross-section.

52. A traction sheave drive assembly for an elevator car which minimizes the space occupied thereby in an elevator shaft, said drive assembly being mounted in said shaft and comprising:

a discoidal electric motor having a stator, a rotor, and an axis of rotation;

a traction sheave driven by said motor on said axis of rotation;

said elevator shaft including a shaft wall adjacent said elevator car;

said shaft wall having a finite thickness;

said discoidal motor being mounted and contained within said shaft;

said traction sheave drive assembly further comprising:

a counterweight for and being mounted in said shaft in a space defined between an edge of said shaft and said elevator car; and a traction rope interconnected between said counterweight, said traction sheave and said elevator car;

said elevator car including rope engaging support structures beneath same;

said traction rope passing beneath said elevator car in engagement with said support structures and having a distal end, remote from said counterweight, attached to a fixed support structure in said shaft.

53. The invention of claim 52, wherein said discoidal motor is mounted and contained within the thickness of said shaft wall.

54. The invention of claim 53, wherein said discoidal electric motor is completely contained within said shaft wall.

55. The invention of claim 52, 53, or 54, wherein said elevator car and said shaft are substantially rectangular in cross-section.

56. The invention of claim 52, wherein the discoidal motor is disposed in an upper part of the shaft wall.

57. A traction sheave drive assembly for an elevator car which minimizes the space occupied thereby in an elevator shaft, said elevator shaft including at least one substantially vertical wall defining a space between it and an adjacent elevator car, said drive assembly being mounted in said shaft and comprising:

a discoidal electric motor having a stator, a rotor, and an axis of rotation oriented in at least an extension of said space in said elevator shaft such that an extension of said axis will intersect the plane of said vertical wall; and a traction sheave mounted on and directly driven by said rotor on said axis of rotation.

58. The invention of claim 57, wherein said drive assembly is so dimensioned as to present said traction sheave in said shaft in an extension of the space defined between said shaft wall and said elevator car adjacent to said wall.

59. The invention of claim 57, wherein said drive assembly is so dimensioned as to present said traction sheave in said shaft in an extension of the space defined between said shaft wall and said elevator car adjacent to said wall;

said shaft wall has a finite thickness;

said discoidal electric motor has a thickness along its axis of rotation no greater than said finite thickness; and said discoidal electric motor is mounted within said shaft wall.

60. The invention of claim 59, wherein said discoidal electric motor is completely contained within said shaft wall.

61. The invention of claim 57, wherein said drive assembly is mounted entirely within said extension of said space.

62. A traction sheave drive assembly for an elevator car which, minimizes the space occupied thereby in an elevator shaft, said drive assembly being mounted in said shaft and comprising:

a discoidal electric motor having a stator, a rotor, and an axis of rotation oriented in said elevator shaft such that an extension of said axis will intersect an adjacent elevator car; and a traction sheave mounted on and directly driven by said rotor on said axis of rotation;

said elevator shaft including a shaft wall adjacent said elevator car;

said shaft wall having a finite thickness; and said discoidal motor being mounted and contained within said shaft.

63. The invention of claim 62, wherein said discoidal motor is mounted and contained within the thickness of said shaft wall.

64. The invention of claim 63, wherein said discoidal electric motor is completely contained within said shaft wall.

65. A method for configuring the space occupied by an elevator car and a drive assembly associated therewith, the drive assembly including a drive motor, a traction sheave, a counterweight, a hoisting rope, and a guide assembly, comprising the steps of:

providing an elevator shaft with a vertically extending boundary;

placing the elevator car in said shaft;

providing at least one substantially vertical wall in the shaft, coextensive therewith and spaced from the elevator car;

providing a first guide assembly in the shaft to hold and define a path of travel for the counterweight;

providing a second guide assembly in the shaft for the elevator car;

spacing said vertical wall from the elevator car to the extent required to accommodate the thickness dimension of the counterweight, said guide assembly, and requisite safety distances, the vertical wall being adjacent the vertically extending boundary of the shaft;

providing at said vertical wall a drive motor and traction sheave assembly with a common axis of rotation, with said common axis of rotation of said assembly oriented to intersect the vertical wall while presenting the traction sheave for rotation in the space co-extensive with said shaft which is defined between the elevator car and said vertical wall, the drive motor being contained within the vertically extending boundary of the shaft; and connecting the hoisting rope with the counterweight and the elevator car through the traction sheave.

66. The method of claim 65, including the further step of mounting the drive motor on said vertical wall adjacent said guide assembly to present the traction sheave for rotation within the space between said vertical wall and the elevator car.

67. The method of claim 65, including the further step of mounting the drive motor on said vertical wall adjacent said guide assembly to present the traction sheave for rotation within the space between the vertical wall and the elevator car; and configuring the drive motor and vertical wall to contain the former within the latter.

68. The method of claim 67, including the further step of configuring the drive motor and traction sheave assembly with a shaft having a length no greater than the spacing between the elevator car and the thickness of said vertical wall.

69. The method of claim 65, 66, or 67, including the further step of configuring the drive motor and traction sheave assembly with a shaft having a length to accommodate presenting said traction sheave within the space between said vertical wall and the elevator car.

70. A method for configuring the space occupied by an elevator car and the drive assembly associated therewith, the drive assembly including a, drive motor, a traction sheave, a counterweight, and a guide assembly, comprising the steps of:

constructing an elevator shaft;

placing the elevator car in said shaft;

providing at least one substantially vertical wall in the shaft, coextensive therewith and spaced from the elevator car;

providing a first guide assembly in the shaft to hold and define a path of travel for the counterweight;

providing a second guide assembly in the shaft for the elevator car;

spacing the vertical wall from the elevator car to the extent required to accommodate the thickness dimension of the counterweight and the first guide assembly;

providing at said vertical wall a drive motor and traction sheave assembly with a common axis of rotation and a substantially flat discoidal configuration, said traction sheave being directly driven by and of lesser diameter than said drive motor;

presenting the traction sheave for rotation in a space between the elevator car and the vertical wall; and connecting the hoisting rope with the counterweight and the elevator car through the traction sheave.

71. The method of claim 70, including the further step of mounting the drive motor on the vertical wall adjacent the first guide assembly to present the traction sheave for rotation within the spade between the vertical wall and the elevator car.

72. The method of claim 70, including the further step of mounting the drive motor on the vertical wall adjacent the first guide assembly to present the traction sheave for rotation within the space between the vertical wall and the elevator car; and configuring the drive motor and traction sheave to present both of these in said elevator shaft in the space between the elevator car and the vertical wall.

73. The method of claim 70, 71, or 72, wherein a shaft is provided along said common axis of rotation, the shaft having a length commensurate with the thickness dimensions of the counterweight and first guide assembly.

74. The method of claim 70, 71, or 72, wherein said common axis of rotation is oriented to intersect the plane of said vertical wall while presenting the traction sheave for rotation in the space co-extensive with said shaft which is defined between the elevator car and said vertical wall.

75. The method of claim 74, wherein a shaft is provided along said common axis of rotation, the shaft having a length commensurate with the thickness dimensions of the counterweight and first guide assembly.

76. A method for configuring the space occupied by an elevator car and the drive assembly associated therewith, the drive assembly including a drive motor, a traction sheave, a counterweight, a hoisting rope, and a guide assembly, comprising the steps of:

providing an elevator shaft;

placing the elevator car in said shaft;

providing at least one substantially vertical wall in the shaft, coextensive therewith and spaced from the elevator car;

providing a first guide assembly in the shaft to hold and define a path of travel for the counterweight;

providing a second guide assembly in the shaft for the elevator car;

spacing the at least one vertical wall from the elevator car only to the extent required to accommodate the thickness dimension of the counterweight, at least one of the guide assemblies, and requisite safety distances;

providing at the at least one vertical wall a drive motor and traction sheave assembly with a common axis of rotation, and configured so that said drive motor has a substantially flat discoidal stator and rotor configuration, with said common axis of rotation of said assembly oriented to intersect the plane of said vertical wall while presenting the traction sheave for rotation in a space co-extensive with said shaft which is defined between the elevator car and said vertical wall;

connecting the hoisting rope with the counterweight and the elevator car through the traction sheave; and suspending the elevator car on the hoisting rope by passing the hoisting rope beneath the elevator car.

77. The method of claim 76, wherein the elevator car is substantially rectangular in cross-section.

78. The method of claim 76, including the further step of mounting the drive motor on the at least one vertical wall adjacent said guide assembly to present the traction sheave for rotation within the space between said vertical wall and the elevator car.

79. The method of claim 78, wherein the elevator car is substantially rectangular in cross-section.

80. The method of claim 76, including the further step of mounting the drive motor on said vertical wall adjacent said guide assembly to present the traction sheave for rotation within the space between the vertical wall and the elevator car; and configuring the drive motor and vertical wall to contain the former within the latter.

81. The method of claim 80, wherein the elevator car is substantially rectangular in cross-section.

82. The method of claim 80, including the further step of configuring the drive motor and traction sheave assembly with a shaft having a length no greater than the spacing between the elevator car and the thickness of said vertical wall.

83. The method of claim 80, wherein the elevator car is substantially rectangular in cross-section.

84. The method of claim 76, 78, or 80, including the further step of configuring the drive motor and traction sheave assembly with a shaft having a length to accommodate presenting said traction sheave within the space between the at least one vertical wall and the elevator car.

85. The method of claim 84, wherein the elevator car is substantially rectangular in cross-section.

86. A method for configuring the space occupied by an elevator car and the drive assembly associated therewith, the drive assembly including a drive motor, a traction sheave, a counterweight, and a guide assembly, comprising the steps of:

providing an elevator shaft in a building within the profile of the latter;

placing the elevator car in said shaft;

providing at least one substantially vertical wall in the shaft, coextensive therewith and spaced from the elevator car;

providing a first guide assembly in the shaft to hold and define a path of travel for the counterweight;

providing a second guide assembly in the shaft for the elevator car;

spacing the vertical wall from the elevator car to the extent required to accommodate the thickness dimension of the counterweight and the first guide assembly;

providing at the at least one vertical wall a drive motor and traction sheave assembly with a common axis of rotation and a substantially flat discoidal configuration, said traction sheave being directly driven by and of lesser diameter than said drive motor;

presenting the traction sheave for rotation in a space between the elevator car and the vertical wall; and connecting the hoisting rope with the counterweight and the elevator car through the traction sheave; and suspending the elevator car on the hoisting rope by passing the hoisting rope beneath the elevator car.

87. The method of claim 86, wherein the elevator car is substantially rectangular in cross-section.

88. The method of claim 86, including the further step of mounting the drive motor on the vertical wall adjacent the first guide assembly to present the traction sheave for rotation within the space between the vertical wall and the elevator car.

89. The method of claim 88, wherein the elevator car is substantially rectangular in cross-section.

90. The method of claim including the further step of mounting the drive motor on the vertical wall adjacent the first guide assembly to present the traction sheave for rotation within the space between the vertical wall and the elevator car; and configuring the drive motor and traction sheave to present both of these in said elevator shaft in the space between the elevator car and the vertical wall.

91. The method of claim 90, wherein the elevator car is substantially rectangular in cross-section.

92. The method of claim 86, 88, or 90, wherein a shaft is provided along said common axis of rotation, the shaft having a length commensurate with the thickness dimensions of the counterweight and first rail assembly.

93. The method of claim 92, wherein the elevator car is substantially rectangular in cross-section.

94. The method of claim 86, 88, or 90, wherein said common axis of rotation is oriented to intersect said vertical wall while presenting the traction sheave for rotation in the space co-extensive with said shaft which is defined between the elevator car and said vertical wall.

95. The method of claim 94, wherein the elevator car is substantially rectangular in cross-section.

96. The method of claim 86, 88, or 90, wherein a shaft is provided along said common axis of rotation, the shaft having a length commensurate with the thickness dimensions of the counterweight and first guide assembly.

97. The method of claim 96, wherein the elevator car is substantially rectangular in cross-section.

98. The method for configuring the space occupied by an elevator car and the drive assembly associated therewith, the drive assembly including a drive motor, a traction sheave, a counterweight, a hoisting rope, and a guide assembly, comprising the steps of:

constructing an elevator shaft;

placing the elevator car in said shaft;

providing at least one substantially vertical wall in the shaft, coextensive therewith and spaced from the elevator car;

providing a first guide assembly in the shaft to hold and define a path of travel for the counterweight;

providing a second guide assembly in the shaft for the elevator car;

spacing said vertical wall from the elevator car to the extent required to accommodate the thickness dimension of the counterweight, said guide assembly, and requisite safety distances;

providing at said vertical wall a drive motor and traction sheave assembly with a common axis of rotation, and configured so that said drive motor has a substantially flat discoidal stator and rotor configuration, with said common axis of rotation of said assembly oriented to intersect the vertical wall while presenting the traction sheave for rotation in a space co-extensive with said shaft which is defined between the elevator car and said vertical wall; and connecting the hoisting rope with the counterweight and the elevator car through the traction sheave.

99. The method of claim 98, including the further step of mounting the drive motor on said vertical wall adjacent said guide assembly to present the traction sheave for rotation within the space between said vertical wall and the elevator car.

100. The method of claim 98, including the further step of mounting the drive motor on said vertical wall adjacent, said guide assembly to present the traction sheave for rotation within the space between the vertical wall and the elevator car; and configuring the drive motor and vertical wall to contain the former within the latter.

101. The method of claim 100, including the further step of providing the drive motor and traction sheave assembly with a shaft along a common axis of rotation, the shaft having a length no greater than the spacing between the elevator car and the thickness of said vertical wall.

102. The method of claim 98, 99, or 100, including the further step of providing the drive motor and traction sheave assembly with a shaft along a common axis of rotation, the shaft having a length to accommodate presenting said traction sheave within the space between said vertical wall and the elevator car.

103. A method for configuring the space occupied by an elevator car and the drive assembly associated therewith, the drive assembly including a drive motor, a traction sheave, a counterweight, a hoisting rope, and a guide assembly, comprising the steps of:

providing an elevator shaft;

placing the elevator car in said shaft;

providing at least one substantially vertical wall in the shaft, coextensive therewith and spaced from the elevator car;

providing a first guide assembly in the shaft to hold and define a path of travel for the counterweight;

providing a second guide assembly in the shaft for the elevator car;

spacing said vertical wall from the elevator car only to the extent required to accommodate the thickness dimension of the counterweight, said guide assembly, and requisite safety distances;

providing at said vertical wall a drive motor and traction sheave assembly with a common axis of rotation, and configured so that said drive motor has a substantially flat discoidal stator and rotor configuration, with the axis of rotation of said assembly oriented to intersect the plane of said vertical wall while presenting the traction sheave for rotation in the space co-extensive with said shaft which is defined between the elevator car and said vertical wall;

connecting the hoisting rope with the counterweight and the elevator car through the traction sheave; and suspending the elevator car on the hoisting rope by passing the hoisting rope beneath the elevator car.

104. The method of claim 103, wherein the elevator car is substantially rectangular in cross-section.

105. The method of claim 103, including the further step of mounting the drive motor on said vertical wall adjacent said guide rail assembly to present the traction sheave for rotation within the space between said vertical wall and the elevator car.

106. The method of claim 105, wherein the elevator car is substantially rectangular in cross-section.

107. The method of claim 103, including the further step of mounting the drive motor on said vertical wall adjacent said guide rail assembly to present the traction sheave for rotation within the space between the vertical wall and the elevator car; and configuring the drive motor and vertical wall to contain the former within the latter.

108. The method of claim 107, wherein the elevator car is substantially rectangular in cross-section.

109. The method of claim 107, including the further step of providing the drive motor and traction sheave assembly with a shaft along a common axis of rotation, the shaft having a length no greater than the spacing between the elevator car and the thickness of said vertical wall.

110. The method of claim 109, wherein the elevator car is substantially rectangular in cross-section.

111. The method of claim 103, 105, or 107, including the further step of providing the drive motor and traction sheave assembly with a shaft along a common axis of rotation, the shaft, having a length to accommodate presenting said traction sheave within the space between said vertical wall and the elevator car.

112. The method of claim 111, wherein the elevator car is substantially rectangular in cross-section.

113. A method for configuring the space, occupied by an elevator car and the drive assembly associated therewith, the drive assembly including a drive motor, a traction sheave, a counterweight, a hoisting rope, and a guide assembly, comprising the steps of:

constructing an elevator shaft;

placing the elevator car in said shaft;

providing at least one substantially vertical wall in the shaft, coextensive therewith and spaced from the elevator car;

spacing the at least one vertical wall from the elevator car to the extent required to accommodate the thickness dimension of the counterweight, the guide assembly, and requisite safety distances;

providing on said guide assembly a drive motor and traction sheave assembly with a common axis of rotation and configured so that said drive motor has a substantially flat discoidal configuration and that said traction sheave has a lesser diameter than said drive motor, with said common axis of rotation of said assembly oriented to intersect the plane of said vertical wall while presenting said traction sheave for rotation in the space coextensive with said shaft which is defined between the elevator car and said vertical wall;

connecting the hoisting rope with the counterweight and the elevator car through the traction sheave; and suspending the elevator car on the hoisting rope by passing the hoisting rope beneath the elevator car.

114. The method of claim 113, wherein the elevator car is substantially rectangular in cross-section.

115. The method of claim 113, wherein the entirety of said drive motor and traction sheave assembly is included in the said space coextensive with said shaft.

116. The method of claim 115, wherein the elevator car is substantially rectangular in cross-section.

117. The method of claim 131, including the step of forming a receiving cavity within the thickness dimension of said vertical wall; and wherein at least a portion of said drive motor is extended into the receiving cavity formed in said vertical wall.

118. The method of claim 113, wherein the elevator car is substantially rectangular in cross-section.

* * * * *